US009339814B2

(12) United States Patent
Nakazawa

(10) Patent No.: US 9,339,814 B2
(45) Date of Patent: May 17, 2016

(54) LIQUID SUPPLY DRIVE MECHANISM USING OSMOTIC PUMP AND MICROCHIP HAVING THE LIQUID SUPPLY DRIVE MECHANISM

(75) Inventor: Takashi Nakazawa, Hachioji (JP)

(73) Assignee: Canon Kabushiki Kaisha, Tokyo (JP)

( * ) Notice: Subject to any disclaimer, the term of this patent is extended or adjusted under 35 U.S.C. 154(b) by 438 days.

(21) Appl. No.: 12/742,078

(22) PCT Filed: Nov. 6, 2008

(86) PCT No.: PCT/JP2008/070632

§ 371 (c)(1),
(2), (4) Date: May 7, 2010

(87) PCT Pub. No.: WO2009/060994

PCT Pub. Date: May 14, 2009

(65) Prior Publication Data

US 2010/0254832 A1 Oct. 7, 2010

(30) Foreign Application Priority Data

Nov. 9, 2007 (JP) ..... 2007-292138

(51) Int. Cl.
*F04B 47/08* (2006.01)
*B01L 3/00* (2006.01)
*F04B 43/10* (2006.01)

(52) U.S. Cl.
CPC ..... *B01L 3/50273* (2013.01); *F04B 43/10* (2013.01); *B01L 2400/046* (2013.01); *B01L 2400/0472* (2013.01)

(58) Field of Classification Search
CPC ..... B01L 3/50273; B01L 2400/046; B01L 2400/0472; F04B 43/10
USPC ..... 417/375; 604/892.1; 436/180; 422/505, 422/502, 68.1, 50, 81, 500, 501
See application file for complete search history.

(56) References Cited

U.S. PATENT DOCUMENTS 3,317,433 A * 5/1967 Eichel ..... 428/402.21
4,207,893 A * 6/1980 Michaels ..... 604/892.1

(Continued)

FOREIGN PATENT DOCUMENTS

EP 796917 A2 9/1997
EP 1649931 A 4/2006

(Continued)

OTHER PUBLICATIONS

Park, Joong Yull et al. "Gradient generation by an osmotic pump and the behavior of human mesenchymal stem cells under the fetal bovine serum concentration gradient." Lab on a Chip (2007) 7 1673-1680.*

(Continued)

*Primary Examiner* — Christopher A Hixson
(74) *Attorney, Agent, or Firm* — Canon USA Inc. IP Division

(57) ABSTRACT

Provided is a microchip having a liquid supply mechanism which can supply a solution in a micro flow path with a simple construction in which a drive source utilizing an osmotic pressure is arranged within the microchip and which controls the osmotic pressure by a control unit utilizing temperature or the like, whereby it is possible to effect drive control such as intermittent driving and continuous driving at a fixed velocity. The liquid supply mechanism using osmotic pressure includes an osmotic pump utilizing the osmotic pressure of a liquid filling chambers separated from each other by a semi-permeable membrane, and a unit which varies the osmotic pressure by changing a condition of the solution in at least one of the chambers on the basis of a timing of a pumping operation.

8 Claims, 4 Drawing Sheets

(56) References Cited

U.S. PATENT DOCUMENTS

| | | | | |
|---|---|---|---|---|
| 5,288,214 | A | 2/1994 | Fukuda et al. | |
| 5,529,685 | A * | 6/1996 | Irie et al. | 210/134 |
| 6,616,652 | B1 * | 9/2003 | Harper et al. | 604/892.1 |
| 2002/0185183 | A1 * | 12/2002 | O'Connor et al. | 137/814 |
| 2005/0059163 | A1 | 3/2005 | Dastane et al. | |
| 2005/0100937 | A1 | 5/2005 | Holmes | |
| 2006/0188403 | A1 | 8/2006 | Parng et al. | |
| 2007/0088338 | A1 * | 4/2007 | Ehwald et al. | 604/892.1 |
| 2007/0135797 | A1 | 6/2007 | Hood et al. | |
| 2007/0135800 | A1 * | 6/2007 | Hood et al. | 604/892.1 |
| 2007/0224264 | A1 * | 9/2007 | Antipov et al. | 424/463 |
| 2009/0123297 | A1 * | 5/2009 | Gu et al. | 417/39 |

FOREIGN PATENT DOCUMENTS

| | | | |
|---|---|---|---|
| JP | 58054962 | A | 4/1983 |
| JP | S58-054962 | A | 4/1983 |
| JP | 62225776 | A | 10/1987 |
| JP | S62-225776 | A | 10/1987 |
| JP | 01126979 | A | 5/1989 |
| JP | H01-126979 | A | 5/1989 |
| JP | 06094669 | A | 4/1994 |
| JP | H06-094669 | A | 4/1994 |
| JP | 2004-053371 | A | 2/2004 |
| JP | 2004053371 | A | 2/2004 |
| JP | 2007-248470 | A | 9/2007 |
| JP | 2009-520511 | A | 5/2009 |
| WO | 01/76743 | A | 10/2001 |
| WO | 2007056501 | A | 5/2007 |
| WO | 2007/112114 | A | 10/2007 |

OTHER PUBLICATIONS

Hattori et al. "Structure and Mechanism of Microcapsule Pump Using Osmotic Pressure Actuator," Nihon Kikai Gakkai ronbunsyu: C hen (1992), vol. 58, No. 552, pp. 2483-2488.

Hattori et al.,"Structure and Mechanism of Microcapsule Pump Using Osmotic Pressure Actuator", Transactions of JSME_1992-8, vol. 58, No. 552, 2483-2488.

Eijkel Jan et al,: "Osmosis and pervaporation in polyimide submicron microfluidic channel strctures", Applied Physics Letters, American Institute of Physics, US. vol. 87. No. 11,, Sep. 8, 2005.

Tanaka S. et al., "Osmotically powered drug-delivery pump using semipermeable hollow fibre", Medical & Biological Engineering & Computing, vol. 24, No. 4, Jul. 1, 1986.

* cited by examiner

LIQUID SUPPLY DRIVE MECHANISM USING OSMOTIC PUMP AND MICROCHIP HAVING THE LIQUID SUPPLY DRIVE MECHANISM

TECHNICAL FIELD

The present invention relates to a liquid supply drive mechanism using an osmotic pump. In particular, the liquid supply drive mechanism of the present invention is applicable to a liquid supply unit for fluid control in a microchip having a minute flow path called a micro channel and a minute structure such as a port within a substrate.

BACKGROUND ART

There is known an osmotic pump utilizing an osmosis phenomenon in which liquid moves through a semipermeable membrane. As an example of a technology utilizing osmosis, Japanese Patent Application Laid-Open No. S58-054962 discloses one in which osmosis is utilized in a liquid extraction pump.

Japanese Patent Application Laid-Open No. H06-094669 also discloses a technology in which solvent is moved by utilizing osmosis to generate a pump function. The publication discloses a technology in which there is provided an osmotic container in which an aqueous solution chamber previously filled with aqueous solution and a water-filled chamber are separated from each other by a semipermeable membrane, osmotic pressure being generated by filling the water filled chamber with water.

With recent development of a three-dimensional fine processing technology, attention is being focused on a system in which there are integrated on a substrate of glass, silicon, or the like a minute flow path, liquid devices such as a pump and a valve, and a sensor, chemical analysis being conducted on the substrate. Such a system as described above is known by the name of micro scale total analysis systems (μTAS). There have been proposed provisions, within a substrate, of minute structures such as a micro channel forming a flow path of a predetermined configuration and a port, and execution of various operations such as chemical reaction, synthesis, refinement, extraction, production, and analysis of a substance in the minute structure. A part of the proposal has been put into practice. The structure which has minute structures such as a micro channel and a port within a substrate is generally referred to as a "microchip."

A microchip is applicable to a wide variety of uses such as gene analysis, clinical diagnosis, medicine screening, and environmental monitoring. A microchip has various advantages, such as (1) a markedly small use amount of the sample and reagent, (2) short analysis time, (3) high sensitivity, (4) portability allowing analysis on the spot, and (5) disposability.

In such a microchip as described above, it is necessary to accurately weigh the liquid component such as reaction liquid, reagent solution, or sample solution, and to deliver the liquid component accurately to a desired position in the channel in the chip.

In view of this, there is a strong demand for development of a microchip as disclosed in Japanese Patent Application Laid-Open No. 2004-053371, and development of a unit capable of accurately weighing the liquid component within the chip and accurately delivering the weighed liquid component to an arbitrary position.

If it is possible to utilize an osmotic pump as described above as the liquid supply drive unit of a microchip, a microchip suitable for solving the above-mentioned problem may be developed. However, no attempt in this line has been made yet.

DISCLOSURE OF THE INVENTION

An osmotic pump has a simple construction and provides an accurate pumping action corresponding to osmotic pressure, and hence if it can be utilized as a liquid supply drive unit of a microchip, it may be possible to provide a microchip capable of achieving liquid supply of higher accuracy.

However, in the prior-art technology relating to the osmotic pump, a difference in concentration for generating a difference in osmotic pressure is adjusted prior to a start of pump operation. When the osmotic pump is used for a flow path, connection to the flow path starts the pumping action.

That is, by utilizing the conventional osmotic pump, it is impossible to control the operation start of the osmotic pump on demand. Moreover, the osmotic pressure is immediately generated if it is placed in an environment where a difference in concentration is generated, and hence it is impossible to effect control so as to generate osmotic pressure whenever the operation is to be performed.

The osmotic pressure serving as the driving force is due to a difference in concentration of a solution generated through a semipermeable membrane. When the difference in concentration has been settled to a fixed level, no more osmotic pressure is generated. Thus, it is rather difficult to use the pump intermittently or multiple times. That is, a construction in which such a conventional pump as described above is arranged z in a microchip as the liquid supply drive mechanism lacks effectiveness. Thus, there has been a demand for a new liquid supply drive mechanism using an osmotic pump which allows adjustment of the operation start of the osmotic pump and the liquid supply by the pump and continuous use and which is of a simple construction. The present invention has been made in view of the above-mentioned problem, and an object of the present invention is therefore to provide a liquid supply control mechanism utilizing osmotic pressure capable of controlling a generation of a predetermined pressure with a desired timing.

In order to solve the above-mentioned problem, according to the present invention, a liquid supply drive mechanism for driving a liquid supply operation through an osmotic pressure of a solution, comprises:

a drive main body portion having two liquid chambers separated from each other by a semipermeable membrane; and a unit which varies the osmotic pressure of an internal liquid filling the two liquid chambers, wherein each of the two liquid chambers has an opening allowing entrance and exit of the internal liquid, and wherein the unit which varies the osmotic pressure varies the osmotic pressure by changing a condition of the internal liquid filling at least one of the liquid chambers.

Further, according to the present invention, a microchip comprises:

a flow path formed in a substrate;

the liquid supply drive mechanism according to the present invention which is connected to the flow path; and a unit which generates an external stimulation for stimulating a concentration changing unit of the liquid supply drive mechanism.

Further, according to the present invention, an analysis device uses a microchip. The analysis device comprises:

a retaining portion for retaining the microchip according to the present invention; and a driving unit for driving an external stimulation generating unit of the microchip.

Further, according to the present invention, a liquid supply operation driving method for driving a liquid supply operation for a liquid to be supplied by utilizing an osmotic pressure of an internal liquid filling two liquid chambers separated from each other by a semipermeable membrane, the method comprises:

varying the osmotic pressure by changing a condition of the internal liquid filling at least one of the liquid chambers; and controlling the liquid supply operation.

According to the present invention, there is arranged within the microchip as a drive source an osmotic pump having the unit which varies the osmotic pressure by changing the condition of the solution in at least one of the two liquid chambers of the osmotic pump separated from each other by the semipermeable membrane. Due to this construction, it is possible to supply the solution in the micro flow path with a simple construction, allowing control of intermittent drive and continuous drive at a fixed speed. Further, even when it is installed in an environment where solvent is supplied, it is possible to control start of a generation of osmotic pressure, and hence it is possible to prevent driving until liquid supply is required.

BEST MODE FOR CARRYING OUT THE INVENTION

Figure 1:
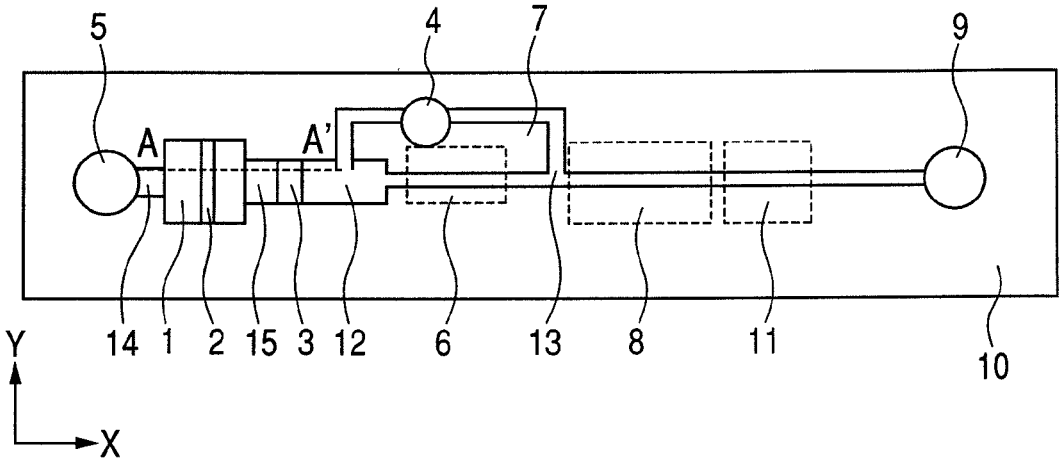
FIG. 1 is a plan sectional view of a microchip with a micro pump according to the present invention incorporated therein.

In order to describe the present invention in detail, an exemplary embodiment for carrying out the present invention will be described.

A liquid supply drive mechanism according to the present invention includes a drive main body portion having two liquid chambers separated from each other by a semipermeable membrane; and a unit which varies the osmotic pressure of a liquid (hereinafter referred to as the internal liquid for distinction from the liquid to be supplied) filling the two liquid chambers of the drive main body portion. Each of the two liquid chambers with which the drive main body portion is provided has an opening allowing inflow and outflow of the internal liquid filling the liquid chambers and the liquid from the outside. The semipermeable membrane is a film which has pores of which sizes are in predetermined range. Therefore, it prevents permeation of solute molecule which is lager than the pore size and selectively allows permeation of small-sized solvent molecule.

The drive main body portion may have a liquid discharge portion capable of accommodating liquid connected to the opening of the liquid chamber into which solvent permeates (flows) through the semipermeable membrane. The liquid discharge portion may, for example, be of a cylindrical or tubular configuration. Due to the provision of the liquid discharge portion, it is possible to secure a region (solution outflow portion) for accommodating the internal liquid flowing out of the opening. Further, the liquid discharge portion may have a region (drive liquid portion) for accommodating the liquid (liquid to be supplied) supplied through liquid supply operation. When the liquid discharge portion has the drive liquid portion, it is desirable that the internal liquid flowing out of the liquid chamber and the liquid to be supplied be prevented from being mixed with each other by a substance separating the solution outflow portion and the drive liquid portion (hereinafter referred to as the separation substance). As the separation substance, there is selected a material capable of moving within the liquid discharge portion while separating the internal liquid in the liquid discharge portion and the liquid to be supplied from each other. Thus, in the liquid drive mechanism, the opening of the liquid chamber may be directly connected to the flow path of the microchip, or connected to the flow path of the microchip through the liquid discharge portion. In any one of connection methods, it is possible to control the movement of the liquid in the flow path of the microchip through a change in the condition of the internal liquid in the liquid chamber generated by a unit which varies the osmotic pressure of the liquid supply drive mechanism. Further, in order that one of the two liquid chambers of the drive main body portion may be capable of taking in solvent, it is possible to connect the solvent inflow portion accommodating solvent to the opening of one liquid chamber.

The osmotic pump is a liquid supply drive mechanism utilizing the osmotic pressure of a solution, and has two liquid chambers connected together so as to allow movement of solvent through a semipermeable membrane, with each liquid chamber having an opening allowing inflow and outflow of liquid. In the osmotic pump, an osmotic pressure is generated from a difference in the concentration of the internal liquid between the liquid chambers, and the solvent permeates from the liquid chamber of lower internal liquid concentration (or internal liquid solely including solvent) to the liquid chamber of higher internal liquid concentration. Thus, the internal liquid is forced out of the opening of the liquid chamber of higher concentration, and a liquid (e.g., solvent) flows from the outside into the opening of the liquid chamber of lower concentration. When the liquid to be supplied is accommodated in the flow path or the like connected to the opening of the liquid chamber of higher concentration, it is possible to force out the liquid to be supplied by the internal liquid forced out of the opening. Thus, in the liquid supply drive mechanism of the present invention, the liquid retaining portion for accommodating the liquid to be supplied may be connected to the opening of the liquid chamber so as to allow communication.

The unit which varies the osmotic pressure varies the osmotic pressure generated in the liquid chamber by changing the condition of the internal liquid filling at least one of the two liquid chambers of the drive main body portion. As the unit which varies the osmotic pressure, it is possible to suitably use a concentration changing unit for changing the concentration of the solution filling at least one of the liquid chambers of the drive main body portion. The concentration changing unit is a unit installed separately from the concentration change due to the solvent (or low concentration solution) supplied to the solvent (or low concentration solution) side liquid chamber as the solution flows out of the solution (or high concentration solution) side liquid chamber of the drive main body portion.

As a concentration changing unit, the liquid supply drive mechanism of the present invention may have, in a region between the semipermeable membrane and the liquid discharge portion in the liquid chamber (solution phase), a solute or a solution covered with a material for separation from the internal liquid filling this region. Further, there is provided a unit which cancels the separation of the solute or solution (hereinafter referred to as the separation canceling unit), and alternatively, a separation canceling unit provided outside the drive main body portion has a portion for operating so as to cancel the separation of the solute or solution. Thus, by controlling the separation canceling unit, the osmotic pressure generation start timing is controlled, and continuous or intermittent generation of osmotic pressure can be obtained. There can exist in the drive main body portion multiple solutes or solutions covered with a separating material, each including a different substance. Through appropriate design of the separated solutes or solutions, it is possible to control the concentration of the solution filling the region between the semipermeable membrane and the liquid discharge portion by the separation canceling unit. Further, it is also possible to adopt a solid substance as the solute, and to arrange it directly in the liquid in the liquid chamber without using any separation canceling unit.

Further, as the unit which varies osmotic pressure, it is also possible to adopt a temperature changing unit for changing the temperature of the internal liquid filling at least one of the two liquid chambers of the drive main body portion. This temperature changing unit may be provided along with the concentration changing unit. For example, when there is used as the concentration changing unit a solute or solution covered with a material for separation from the internal liquid, the temperature changing unit may be used as the separation canceling unit.

Further, as the unit which varies osmotic pressure, it is also possible to provide a unit which adds a new solution to at least one of the two liquid chambers of the drive main body portion.

The present invention further provides a method of driving a liquid supply operation for a liquid to be supplied by the osmotic pressure of an internal liquid filling two liquid chambers separated from each other by a semipermeable membrane, in which the osmotic pressure is varied by changing the condition of the internal liquid filling at least one of the liquid chambers to thereby vary the osmotic pressure and control the liquid supply operation. As the unit which varies the osmotic pressure, it is possible to use the unit used in the above-mentioned liquid supply drive mechanism.

Further, the present invention includes a microchip having the above-mentioned liquid supply drive mechanism and a base member (substrate) in which there is formed a flow path connected to the liquid supply drive mechanism. As the base member having the flow path, it is possible, for example, to form a groove serving as a flow path in the base member, and to use the substrate in the form of a flat plate as a cover member to thereby form the flow path. When using a concentration changing unit as the unit which varies the osmotic pressure and is used in the liquid supply drive mechanism, it is desirable for the microchip to further include an external stimulation generating unit for stimulating the concentration changing unit.

In addition, the present invention further includes an analysis device using the above-mentioned microchip. The analysis device at least includes a retaining portion for retaining the microchip. When the microchip has an external stimulation generating unit, it is desirable for the analysis device to further include a drive unit for driving the external stimulation generating unit.

In the liquid supply operation driving method of the present invention, the operation of supplying the liquid to be supplied is driven by the osmotic pressure of the internal liquid filling two liquid chambers separated from each other by a semipermeable membrane. Further, by changing the condition of the internal liquid filling at least one of the liquid chambers, the osmotic pressure is varied to thereby control the liquid supply operation.

(First Embodiment)

In this embodiment, as described below, a concentration changing unit is used as the unit which varies the osmotic pressure.

Figure 3:
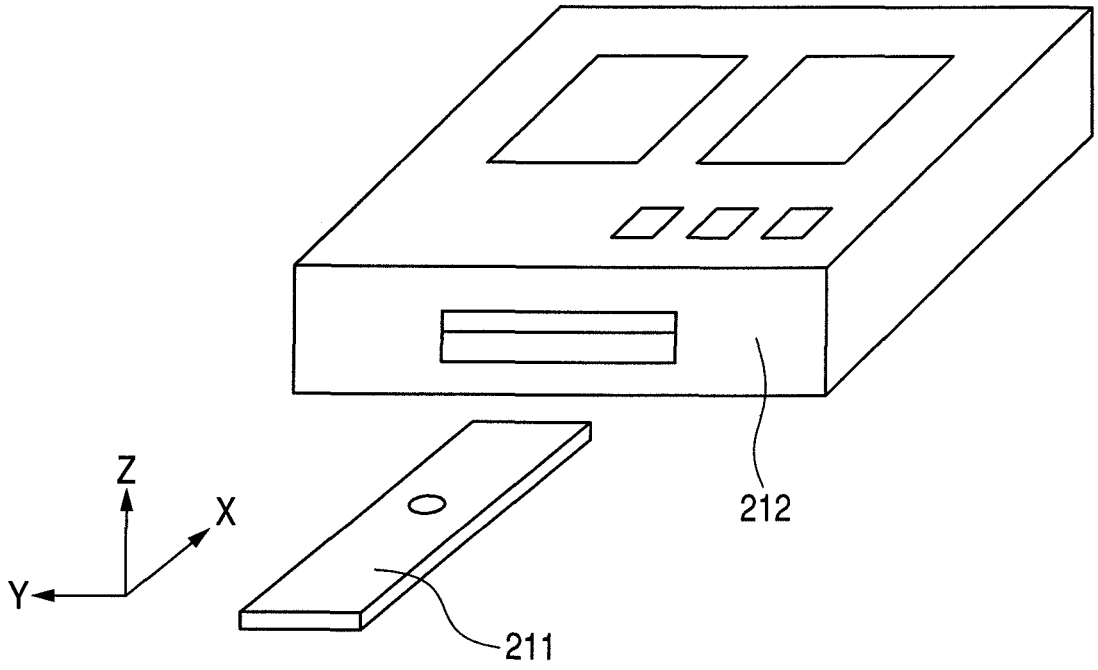
FIG. 3 is a perspective view of an analysis device and a microchip.

FIG. 3 is a perspective view of a microchip using a liquid supply mechanism according to the present invention and an example of the analysis device thereof. In FIG. 3, the X-direction is the longitudinal direction of the chip, in which the liquid supply is effected; the Y-direction is the lateral direction of the chip; and the Z-direction is the thickness direction of the chip.

Numeral 211 denotes a microchip, and numeral 212 denotes an analysis device. Blood, which constitutes the specimen, is injected into the microchip 211 and mixed with a reagent. When the microchip 211 is applied to the analysis device, the analysis device performs analysis by effecting a biochemical reaction such as an antigen-antibody reaction or a nucleic acid hybridization reaction on the cells, microorganisms, chromosomes, nucleic acid, etc. from the specimen supplied from the microchip.

FIG. 1 is a plan sectional view of an embodiment of the present invention, illustrating the microchip 211 illustrated in FIG. 3. Numeral 10 denotes the microchip; 5, a solvent inflow port; 14, a solvent inflow portion; 15, a solution outflow portion; and 1, a drive main body portion, in which there is provided a semipermeable membrane 2. When solvent is caused to flow from the solvent inflow port 5, the semipermeable membrane 2 which has pores of predetermined sizes specifically allows permeation of small-sized solvent molecule. Examples of the material of the semipermeable membrane 2 include polyamide type or cellulose type polymer materials. Numeral 3 denotes a separation substance which is driven by the pressure from the drive main body portion, and is formed of a polymer gel or the like. Numeral 12 denotes a drive liquid portion for accommodating the liquid to be supplied through driving of the separation substance by the liquid from the solution outflow portion 15. The liquid discharge portion is formed of the solution outflow portion 15 and the drive liquid portion, and constitutes the region in which separation substance can be moved.

Numeral 4 denotes a specimen introduction port through which the specimen is introduced into the micro flow path, and numeral 6 denotes a reagent flow path, in which one or multiple kinds of reagents exist while divided by buffers at intervals. After the introduction of the specimen, the specimen introduction port 4 is covered prior to the driving of the pump, preventing liquid from flowing out of the chip. A specimen inflow portion 7 and a reagent inflow portion 6 are joined into one flow path at a mixing point 13, and mixing is effected in a mixing region 8 during liquid supply processing, and detection is effected in a detection region 11. Examples of the detection method include electro-chemical detection and detection using fluorescence. Numeral 9 denotes a waste liquid portion, from which the detected liquid is finally discharged to the exterior of the substrate as waste liquid.

Figure 2:
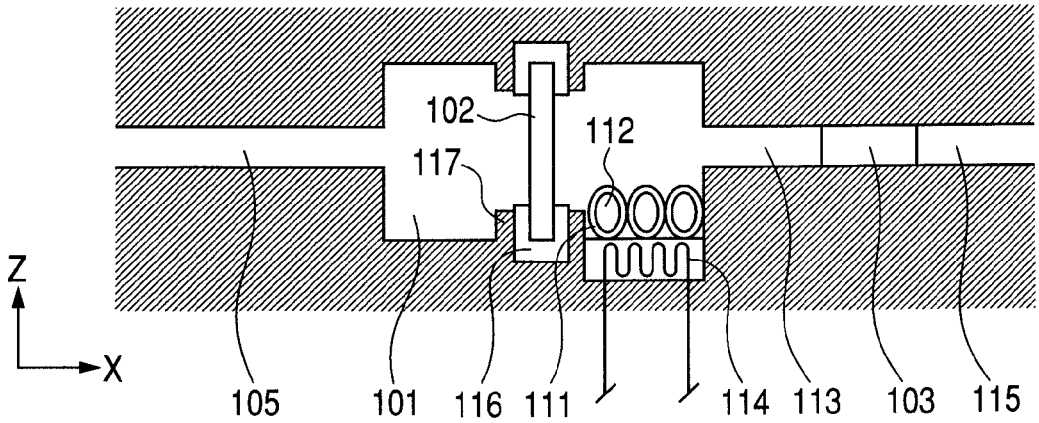
FIG. 2 is an enlarged view of the micro pump of the present invention.

FIG. 2 is a diagram illustrating in detail the construction of the drive main body portion, which is the drive source of FIG. 1, and the periphery thereof, and is a section view taken along the line A-A' of FIG. 1.

Numeral 101 denotes a drive main body portion; 105, a solvent inflow portion; 113, a solution outflow portion; 102, a semipermeable membrane; and 103, a separation substance.

The peripheral portion of the semipermeable membrane 102 is retained by a membrane holder 116, and the semipermeable membrane is fixed in position by inserting the membrane holder into a membrane holder insertion hole 117 of the pump. The separation substance 103 divides the solution outflow portion 113 and the drive liquid portion 115 from each other. Numeral 112 denotes a water-soluble solute or solution, and numeral 111 denotes a separating material for separating the solute or solution from the solvent in the drive main body portion and includes, for example, a capsule material made of a melamine resin. Numeral 114 denotes a unit which cancels the separation by the separating material 111 (hereinafter also referred to as the separation canceling unit), and is a temperature control mechanism such as a heater. While in this embodiment the heater is mounted in the microchip 211, it may also be provided on the analysis device 212 side.

The analysis device 212 also serves as a power source for supplying power for causing the heater to function. The forward end of the nichrome wire of the heater of FIG. 2 is connected to a power source portion (not shown) contained in the analysis device 212, whereby the heater is started. The connection can be effected with an arbitrary timing by a switch.

Due to this construction, when the microchip 211 is placed in the analysis device 212, power is applied to the heater from the analysis device 212 with an arbitrary timing thereby controlling the starting of the heater.

The solute is not restricted to one separated from the solvent by a material such as a capsule material, and the solute may be allowed to exist as it is. Through an increase in temperature by a temperature control mechanism such as a heater, heat is supplied to increase the dissolution degree of the solute, thereby controlling the amount of solute dissolved in the solvent and adjusting the concentration.

Next, the actual driving principle will be described in detail. Referring to FIG. 2, at the time of production of the micro flow path, the wall of the semipermeable membrane 102 is provided in the liquid chamber which the drive main body portion 101 includes. In the region between the semipermeable membrane and the solution outflow portion 113, there exists the solute or solution 112 covered with the separating material 111 such as a capsule material, and the solute or solution is sealed in the drive main body portion at the time of production of the micro flow path. The solute is a water-soluble substance such as sodium chloride, acetic acid, or sucrose, and there exist multiple kinds of solute, each being covered with a capsule material of a different melting temperature.

Figure 4:
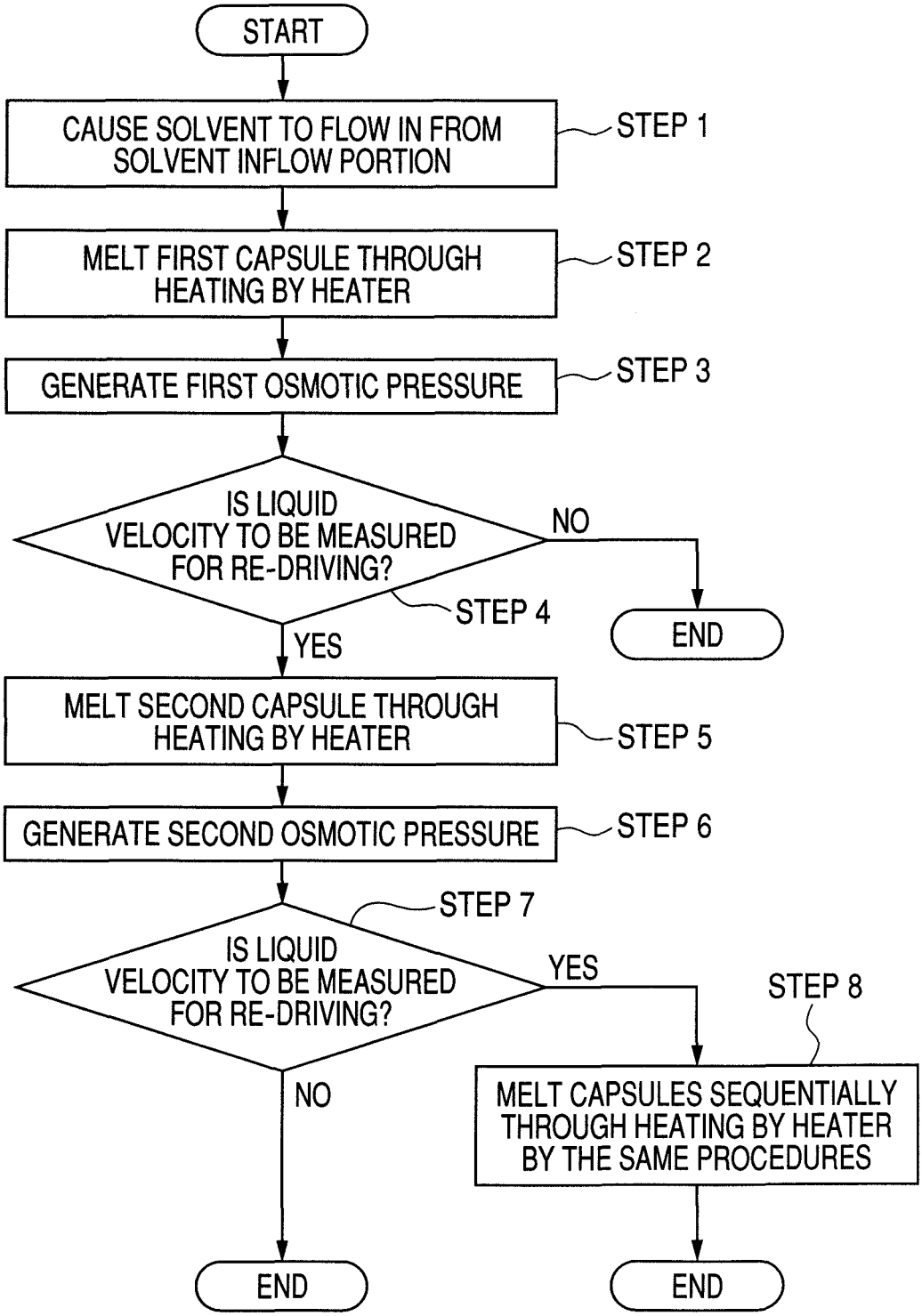
FIG. 4 is a flowchart illustrating processing procedures in a first embodiment.

FIG. 4 is a flowchart illustrating the flow of actual procedures.

When driving is to be performed, solvent is caused to flow from the solvent inflow port 5, and the solvent passes through the solvent inflow portion 105 before flowing into the drive main body portion 101 (step 1). The semipermeable membrane 102 is a film which has pores of which sizes are in predetermined range, and specifically allows permeation of only small-sized solvent molecule, and hence the solvent fills the region between the solvent inflow portion and the semipermeable membrane, and, finally, the region between the liquid discharge portion and the semipermeable membrane. With the drive main body portion being filled with solvent, the temperature is raised by the heater 114, and the capsule materials 111 are sequentially melted, starting with the one of low melting point (step 2). When the content of the capsule materials is sodium chloride, melting of the capsule materials 111 results in the dissolution of the sodium chloride being dissolved in the solvent, generating sodium chloride water between the semipermeable membrane and the liquid discharge portion, with the result that there is generated a difference in concentration in the drive main body portion through the semipermeable membrane. Then, there is generated an osmotic pressure causing solely the solvent to move toward the sodium chloride water of high concentration from the solvent inflow portion side through the semipermeable membrane, and the osmotic pressure is generated until the concentration of the sodium chloride water attains equilibrium (step 3).

The osmotic pressure of the liquid can be calculated from the van't Hoff equation as follows.

When the solute is a non-electrolyte, the osmotic pressure $\pi$ (atm)=R×T×C, and when the solute is an electrolyte, the osmotic pressure $\pi$ (atm)=i×R×T×C, where R=gas constant 0.082 (atm L/mol K);

T=absolute temperature (K);

C=molar concentration (mol/L);

i=van't Hoff factor=$\phi$×z;

$\phi$=osmosis coefficient; and z=number of ions resulting from ionization of the solute.

For example, the osmotic pressure of sodium chloride water of 0.15 (mol/L) at 25° C. is obtained as follows: since the osmosis coefficient $\phi$ of sodium chloride is 0.9355, the osmotic pressure $\pi$ (atm)=i×R×T×C=0.9355×2×0.082×(273+25)×0.15=6.85 (atm).

That is, according to the van't Hoff equation, the osmotic pressure $\pi$ is proportional to the liquid temperature T, and hence, by simply raising the temperature of the liquid by the temperature control unit, it is possible to increase the osmotic pressure n.

Further, when the sodium chloride in the capsule materials diffuses into the solvent, it is possible to increase the diffusion efficiency by imparting ultrasonic vibration to the microchip.

The solution, which has been increased as a result of permeation of the solvent into the solution side liquid chamber due to the osmotic pressure, flows into the liquid discharge portion, whereby the polymer gel 103, which is the separation substance, is forced out, and the liquid contained in the drive liquid portion 115 is supplied. As a result of the supply of the liquid contained in the drive liquid portion 115, the reagent inflow portion 6 and the specimen inflow portion 7 are driven, and the mixing of the reagent and the specimen starts at the mixing point 13. The mixing is effected uniformly in the mixing region 8, and the supply is finally performed up to the detection region 11, where detection is effected.

Further, in the reagent inflow portion 6, it is possible to effect supply continuously, with buffers being placed between different reagents at certain intervals. Thus, it is possible to supply different reagents simultaneously, with buffers being arranged therebetween, mixing the them with the specimen at the joint point 13.

Further, at the time of mixing, it may be possible to stop liquid supply temporarily and then perform operation again, or to move solution at a fixed velocity at the time of mixing and detection. Thus, when intermittent driving is to be effected, the following procedures are performed. First, in order to ascertain a reduction in osmotic pressure, the analysis device 212 has a velocity measurement function to measure the flow velocity at the liquid drive portion 115. On the basis of the velocity thus measured, it is possible to know an optimum timing with which the next capsule is to be melted (step 4).

That is, when the velocity is reduced, and there is no osmotic pressure of the eluted sodium chloride water as a result of melting of the capsule of lowest melting temperature (first capsule), the temperature of the temperature control mechanism such as a heater is raised, and then the capsule of the second lowest melting temperature (second capsule) is melted (step 5). Further, when the solute in the second capsule is dissolved and a difference in concentration is generated again, a new osmotic pressure is generated (step 6). Similarly, when driving is to be performed again, the timing with which the capsule is melted is judged by measuring the velocity at the liquid drive portion (step 7), and the next capsule is melted to generate an osmotic pressure (step 8).

As a result, it is possible to again move the solution, which has been at rest. When supplying the solution continuously at a fixed velocity, there are prepared multiple capsules of different melting temperatures, and the melting is expedited. When the osmotic pressure to be obtained by melting the first capsule has been reduced, the temperature is raised to melt the second capsule, newly generating an osmotic pressure.

As described above, in this process, it is desirable for each solute or solution consisting of a different substance to be covered with a different capsule material. Suppose, for example, there exist sodium chloride covered with a first capsule and glucose covered with a second capsule of higher melting temperature. When the first capsule is melted, and the sodium chloride therein is dissolved in the solvent, a first osmotic pressure is generated. If the second capsule is formed of the same sodium chloride, the solute is only dissolved by a fixed value since the amount of solute to be dissolved in solvent of a fixed volume is peculiar to the substance. Thus, when the same solute is put in different capsules and dissolved in solvent, the dissolution is saturated and stopped at a certain stage, and hence no new osmotic pressure is generated. In view of this, sodium chloride is sealed in the first capsule, and glucose is sealed in the second capsule. When different solutes are thus sealed in different capsules, a new osmotic pressure due to the concentration of the glucose is generated if the osmotic pressure due to the concentration of the sodium chloride is stopped, thus generating and maintaining a still higher osmotic pressure.

While in the above-mentioned flowchart encapsulated solutes are arranged in the drive main body portion for one of the two liquid chambers separated from each other by a semipermeable membrane, it is also possible to arrange capsules for both of the two liquid chambers. For example, in the drive main body portion, encapsulated solutes are also sealed in the region between the solvent inflow portion 105 and the semipermeable membrane 102, and a temperature control unit such as a heater is also provided in this region. With this construction, it is possible to vary the concentration of the solution in the two liquid chambers through temperature control. When the concentration in the region between the solvent inflow portion 105 and the semipermeable membrane 102 is increased, there is exerted an attraction force restoring solvent from the liquid discharge portion to the solvent inflow portion through the semipermeable membrane. As a result, it is possible to supply the separation substance not only in one direction but also in a reciprocating manner.

This embodiment, in which the micro pump utilizing osmotic pressure of the present invention is applied to a microchip by way of example, should not be construed restrictively. While in the example illustrated in FIG. 1, one pump and one flow path exist in the chip, this should not be construed restrictively, and the present invention is also applicable to a system in which multiple pumps and flow paths exist in the chip. As for the content to be covered with the capsules, it is not restricted to sodium chloride, and any other substance will do as long as it is soluble in water. Further, a substance which is not a solute but a solution with a solute dissolved therein is also applicable. Further, the capsule material is not restricted to melamine resin, and it is also possible to adopt other materials such as urethane resin, gelatin, and urea. The separation substance is not restricted to a polymer gel, and any other substance will do as long as it can divide liquid. For example, an air bubble is also applicable. Further, the retaining member such as a capsule material covering the solute can be broken up not only through temperature control using a heater, which is a external stimulation generating unit for imparting heat as an external stimulation, but also by a unit which effect braking-up by applying vibration or electromagnetic waves as an external stimulation. The vibration as the stimulation may, for example, be an ultrasonic vibration. Such ultrasonic waves and electromagnetic waves can be applied in a non-contact fashion and allow operation from a remote site. Further, they are superior in terms of controllability. Multiple retaining members covering the solute may be individually arranged in the liquid chambers, and the retaining members may be formed of different materials. For example, depending upon the degree to which the external stimulation is applied, a retaining member of a different kind may be selected, whereby it is possible to selectively discharge a solute or a solvent covered with a retaining member. Thus, if the material is the same, when the thickness, etc. differ, it is possible to selectively discharge the solute or solvent in the retaining member by an external stimulation.

(Second Embodiment)

In the method of the first embodiment, concentration is adjusted by using a temperature control unit as a concentration changing unit in an osmotic pump utilizing the osmotic pressure of a liquid filling two liquid chambers separated from each other by a semipermeable membrane. In the method of this embodiment, the concentration of the solute of the solution in at least one of the two liquid chambers is changed without performing any temperature control.

Figure 5:
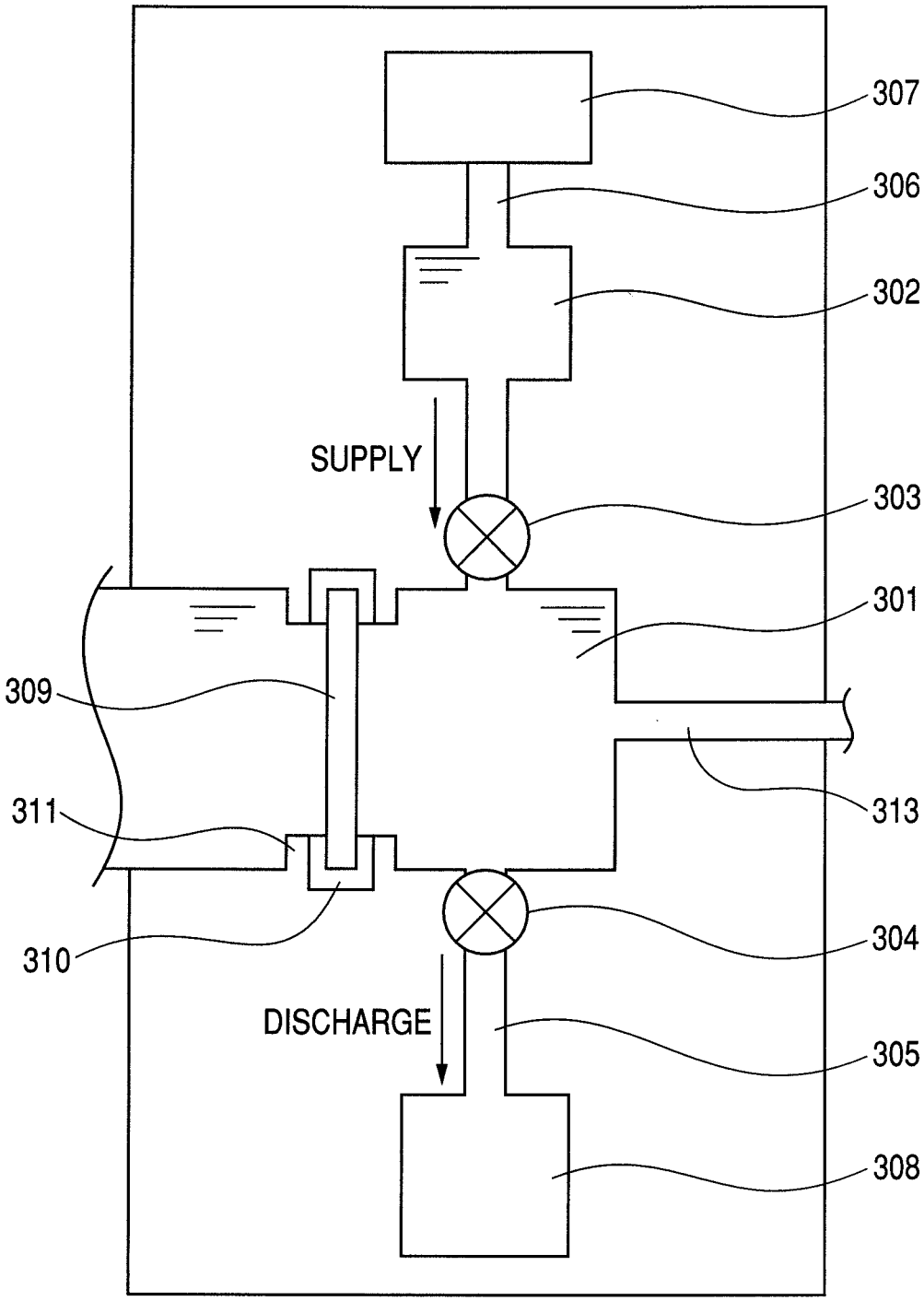
FIG. 5 is a sectional view of a construction of a pump portion according to a second embodiment.

FIG. 5 is a sectional view of a microchip, illustrating one of the two liquid chambers in a pump separated from each other by a semipermeable membrane in the pump as illustrated in FIG. 2. Numeral 313 denotes a solution outflow portion, numeral 301 denotes a drive main body portion, numeral 302 denotes a solution supply port, numeral 305 denotes a liquid discharge port, numeral 303 denotes a supply valve, numeral 304 denotes a discharge valve, numeral 306 denotes a high concentration solution filling chamber, numeral 307 denotes a solution drive device, numeral 308 denotes a discharge solution filling chamber, numeral 309 denotes a semipermeable membrane, numeral 310 denotes a membrane holder, and numeral 311 denotes a membrane holder insertion hole. The peripheral portion of the semipermeable membrane 309 is held by the membrane holder 310, and the semipermeable membrane is fixed in position by inserting the membrane holder into the membrane holder insertion hole 311 of the pump.

Of the two liquid chambers separated from each other by the semipermeable membrane of the drive main body portion 301, the liquid chamber connected to the solution outflow portion 313 is filled with a high concentration solution. When the other chamber is filled with a solution of lower solute concentration than the above-mentioned solution, more preferably, with solvent alone, an osmotic pressure is generated, and solvent flows into the chamber filled with the high concentration solution through the semipermeable membrane. As the difference in concentration between the two liquid chambers decreases, the osmotic pressure generated also decreases. Thus, in order to achieve an increase in concentration, the following operation is performed.

Suppose the high concentration solution filling chamber 306 is filled with a high concentration solution in which a solute is dissolved. When, in this condition, the supply valve 303 is opened, the solution in the high concentration solution filling chamber 306 is supplied to the drive main body portion 301 through the solution supply port 302 by the solution drive device 307. Note that a pump according to the present invention, which utilizes osmotic pressure, may be connected in parallel to the solution drive device 307 to be used as the drive source.

Simultaneously with the supply valve 303, the discharge valve 304 is opened, and the increment portion is discharged through the liquid discharge port 305 and allowed to escape into the discharge solution filling chamber 308. Through opening/closing of the valves and control of the solution drive device 307, the amount of solution flowing into the liquid chambers and the amount of solution flowing out of the liquid chambers are controlled, whereby it is possible to maintain a fixed difference in concentration of the liquid in the liquid chambers.

While in this embodiment a solution supply port, a liquid discharge port, a valve, a high concentration solution filling chamber, a solution drive device, and a discharge solution filling chamber are arranged for one of the two liquid chambers separated from each other by a semipermeable membrane, the construction for solution replacement is not restricted to this one.

The present invention is not limited to the above embodiments and various changes and modifications can be made within the spirit and scope of the present invention. Therefore to apprise the public of the scope of the present invention, the following claims are made.

This application claims the benefit of Japanese Patent Application No. 2007-292138, filed Nov. 9, 2007, which is hereby incorporated by reference herein in its entirety.

The invention claimed is:

1. A microchip comprising:

a flow path formed in a substrate;

a specimen introduction port which is connected to the flow path; and a liquid supply drive mechanism formed in the substrate for driving a liquid supply using an osmotic pressure of an internal liquid, wherein the liquid supply drive mechanism comprises:

a drive main body portion having two liquid chambers separated from each other by a semipermeable membrane; and wherein each of the two liquid chambers has an opening allowing entrance and exit of the internal liquid, and a portion which causes a difference in concentration between the two liquid chambers by changing a condition of the internal liquid filling at least one of the liquid chambers by at least one mechanism selected from the group consisting of heat, vibration, sonic wave and electromagnetic wave, wherein the opening of one of the two liquid chambers is connected with the flow path, and wherein the internal liquid in the chambers and a drive liquid in the flow path are divided by a separation substance which prevents the internal liquid and the drive liquid from being mixed together as the separation substance moves within the flow path, the flow path dimensioned to operably house the separation substance as it moves along its length, and wherein the separation substance is a substance that is different from the internal liquid.

2. The microchip of claim 1, wherein the portion which causes a difference in concentration between the two liquid chambers adds a new solution to at least one of the two liquid chambers.

3. The microchip of claim 1, wherein the condition of the internal liquid is changed by release of a substance from a capsule.

4. The microchip according to claim 1 further comprising plural flow paths and plural drive main body portions.

5. The microchip according to claim 1, wherein one of the chambers is connected to a solution supply port via an opening other than one connected to the flow path.

6. The microchip according to claim 1, wherein the liquid chambers have a cylindrical or tubular configuration.

7. The microchip according to claim 1, wherein the separation substance is a polymer gel or an air bubble.

8. The microchip according to claim 3 wherein the capsule comprises at least one material selected from melamine resin, urethane resin, gelatin and urea.

* * * * *